United States Patent [19]

Dellinger et al.

[11] Patent Number: 4,573,540

[45] Date of Patent: Mar. 4, 1986

[54] METHOD FOR DRILLING DEVIATED WELLBORES

[75] Inventors: Thomas B. Dellinger, Duncanville; Eugene A. Hoppe, Kingwood; Charles E. Jones, Houston, all of Tex.

[73] Assignee: Mobil Oil Corporation, New York, N.Y.

[21] Appl. No.: 672,757

[22] Filed: Nov. 19, 1984

[51] Int. Cl.[4] ..... E21B 7/04; E21B 47/022

[52] U.S. Cl. ..... 175/61; 175/73; 175/45; 166/242

[58] Field of Search ..... 175/61, 62, 73–75, 175/79, 45, 320, 257, 262, 8; 166/50, 242, 285

[56] References Cited

U.S. PATENT DOCUMENTS

| | | | |
|---|---|---|---|
| 3,101,798 | 8/1963 | Wilson et al. | 175/8 |
| 4,396,075 | 8/1983 | Wood et al. | 175/61 X |
| 4,431,068 | 2/1984 | Dellinger et al. | 175/61 |

*Primary Examiner*—James A. Leppink
*Assistant Examiner*—David J. Bagnell
*Attorney, Agent, or Firm*—A. J. McKillop; Michael G. Gilman; George W. Hager, Jr.

[57] ABSTRACT

Directional drilling of a high-angle wellbore is carried out by the drilling of a vertical first portion to a kick-off point at which a high-angle, deviated second portion is initiated. The wellbore is cased to at least below the kick-off point. A casing liner is lowered through the wellbore so that it extends coextensively with the casing. The liner is spaced from the casing by a casing hanger positioned above the kick-off point. The liner is sealed in the casing and prevented from rotating during drilling by a packer bore receptacle positioned between the lower end of the liner and the casing. During the drilling of the deviated second portion of the wellbore, the casing liner protects the casing from wear due to the rotation of the drill string as it lies on the lower side of the high-angle wellbore.

10 Claims, 1 Drawing Figure

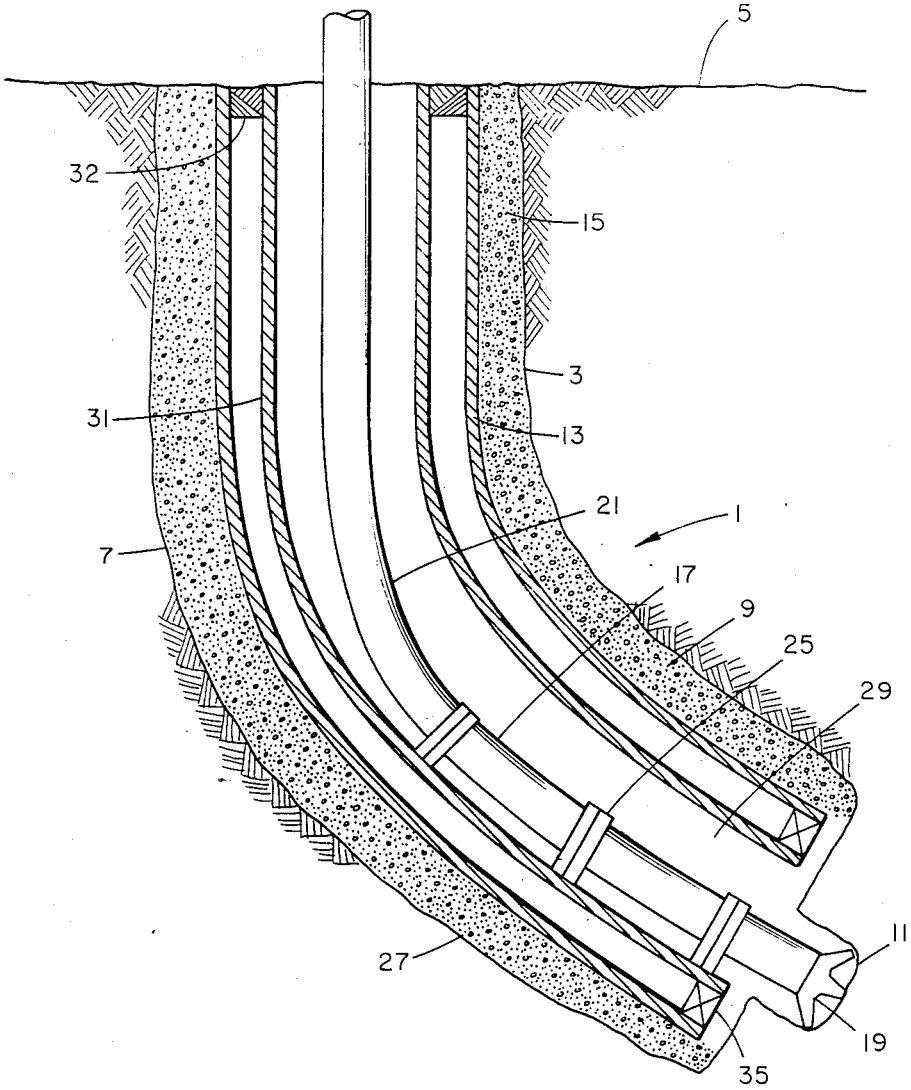
5
32
15
3
31
13
21
1
7
17
9
25
29
11
27
19
35

METHOD FOR DRILLING DEVIATED WELLBORES

BACKGROUND OF THE INVENTION

The present invention relates to rotary drilling and, more particularly, to a directional drilling technique for providing deviated wellbores at significantly greater inclinations and/or over horizontal distances substantially greater than that currently being achieved by conventional directional drilling practices. The success of such directional drilling should benefit mainly offshore drilling projects as platform costs are a major factor in most offshore production operations. Wellbores with large inclination or horizontal distance offer significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle directional drilling. In greater particularity, hole inclinations of 60° or greater, combined with long sections of hole or complex wellbore profiles present significant problems which need to be overcome. The force of gravity, coefficients of friction, and mud particle settling are the major physical phenomena of concern.

In the rotary drilling of a highly deviated wellbore into the earth, a drill string comprised of drill collars and drill pipe is used to advance a drill bit attached to the drill string into the earth to form the wellbore. As the inclination of the wellbore increases, the desired weight-on-bit for effective drilling from the drill string lying against the low side of the wellbore decreases as the sine of the inclination angle. The force resisting the movement of the drill string along the inclined wellbore is the product of the apparent coefficient of friction and the sum of the forces pressing the string against the wall. At an apparent coefficient of friction of approximately 0.58 for a common water base mud, drill strings tend to slide into the hole from the force of gravity at inclination angles up to approximately 60°. At higher inclination angles, the drill strings will not lower from the force of gravity alone, and must be mechanically pushed or pulled, or alternatively, the coefficients of friction can be reduced.

In U.S. Pat. No. 4,431,068 to Dellinger and Gravley, there is described a method of drilling a highly deviated wellbore into the earth's crust by a rotary drilling technique wherein a drill string comprised of drill collars and drill pipe is used to advance a drill bit attached to the drill pipe at the lower end of the drill string into the earth and form the wellbore. A first portion of the wellbore is formed to extend essentially vertically into the earth's crust from a surface location thereof to a kick-off point at the lower end of the first portion. A second portion of the wellbore is initiated at the kick-off point which second portion is deviated to a highly deviated attitude from the vertical. The second portion of the wellbore is formed and extended into the earth with the drill string arranged to provide for the drill collars to be located within the first vertical portion and the drill pipe and bit to be located within the second deviated portion of the wellbore. The second portion of the wellbore is extended until the lower end of the lowermost drill collar in the first vertical portion of the wellbore descends to a location of about the kick-off point. Thereafter the drill string is at least partially pulled from the wellbore and additional drill pipe is added thereto below the drill collars after which drilling is continued to extend the second portion of the wellbore further into the earth's crust.

SUMMARY OF THE INVENTION

In accordance with the present invention, there is provided a method and system for drilling a deviated wellbore into the earth by rotary drilling wherein a drill string is used to advance a drill bit through the earth and a drilling fluid is circulated down the drill string and returned from the wellbore in the annulus formed about the drill string.

A vertical first portion of the wellbore is drilled into the earth from a surface location to a kick-off point by rotating and advancing a drill string and drill bit into the earth. A deviated second portion is initiated at the kick-off point. The drill string and drill bit are then withdrawn from the wellbore. A casing is lowered into the wellbore and cemented into place from the earth's surface to a point below the kick-off point. A casing liner is next lowered within the casing and fixed in spaced position from the casing by a casing hanger located above the kick-off point. This liner has an outside diameter less than the inside diameter of the casing and extends coextensively with the casing from at least above the kick-off point to the lower end of the casing below the kick-off point. It is further sealed in the casing and prevented from rotating during drilling by a mechanism, such as a packer bore receptacle, positioned between the lower end of the liner and the casing.

The drill string and drill bit is then re-run into the wellbore through the liner until the drill string lies along the lower side of the casing and the drill bit is located at the lower end of the liner. In this way the casing is not damaged by the rotation of the drill string during the continued drilling of the deviated second portion of the wellbore. After excessive wear has been imparted to the liner by the rotation of the drill string as it lies on the lower side of the liner, the drilling is discontinued and the drill string and drill bit are withdrawn from the wellbore. At this time the liner is removed and a replacement liner lowered within the casing. This replacement liner is spaced and affixed inside the casing as was the original liner, and also extends coextensively with the casing to the lower end of the casing below the kick-off point. The drill string and drill bit are again re-run into the wellbore and drilling of the deviated second portion of the wellbore continued.

Such replacement of the casing liner for excessive wear during drilling may be repeated after a plurality of drilling intervals until the drilling operation has been completed.

BRIEF DESCRIPTION OF THE DRAWING

The sole FIGURE is a schematic drawing of a deviated wellbore extending into the earth in which there is positioned the casing liner of the present invention for the protection of the cemented casing against wear damage from rotation of the drill tool as it lies on the lower side of the wellbore or is pulled into the upper side of the wellbore.

DESCRIPTION OF THE PREFERRED EMBODIMENT

Referring to the FIGURE, there is shown a wellbore 1 having a vertical first portion 3 that extends from the surface 5 of the earth to a kick-off point 7 and a deviated second portion 9 of the wellbore which extends from the kick-off point 7 to the wellbore bottom 11. A casing 13 is shown in the wellbore surrounded by a cement sheath 15. A drill string 17, having a drill bit 19 at the lower end thereof, is shown in the wellbore 1. The drill string 17 is comprised of drill pipe 21 and the drill bit 19, and will normally include drill collars (not shown). The drill pipe 21 is comprised of joints of pipe that are interconnected together by either conventional or eccentric tool joints 25, as is also illustrated in U.S. Pat. No. 4,246,975, in the vertical first portion 3 of the wellbore extending in the open hole portion thereof below the casing 13 as well as in the deviated second portion 9 of the wellbore. The tool joints 25 in the deviated second portion 9 of the wellbore rest on the lower side 27 of the wellbore and support the drill pipe 21 above the lower side 27 of the wellbore.

In drilling of the deviated wellbore, drilling fluid (not shown) is circulated down the drill string 17, out of the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21. The eccentric tool joints 25 resting on the lower side 27 of the wellbore support the drill pipe 21 above most of these cuttings. During drilling operations, the drill string 17 is rotated and the rotation of the eccentric tool joints 25 causes the drill pipe 21 to be eccentrically moved in the wellbore. This movement of the drill pipe 21 tends to sweep the drill cuttings (not shown) from the lower side of the wellbore 27 into the main stream of flow of the returning drilling fluid in the annulus 29, and in particular into that part of the annulus which lies around the upper side of the drill pipe 21, where they are better carried by the returning drilling fluid to the surface of the earth.

Maintaining the desired weight on the drill bit 19 is a serious problem in drilling high-angle wellbores with inclinations greater than about 60°. For example, a drill collar, laying in an 80° deviated wellbore with a zero coefficient of friction has only 17% of its weight available for pushing on the drill bit. A 0.2 coefficient of friction might be expected with oil mud on a sliding smooth surface. At this coefficient of friction, the drill collar will not slide into the 80° wellbore and will not add any weight to the drill bit. The actual apparent coefficient of friction in the axial direction will most likely be greater than 0.2 with a non-rotating drill string and, by the principle of compound coefficient of friction, be between 0.0 and 0.2 for a rotating drill string. Any movement of the drill string causes wear on the casing 13. Also, since all the weight of the drill string would be against the lower side of the wellbore, the edges of the tool joints and any stabilizers will dig into the wellbore wall, thereby increasing the apparent coefficient of friction in the axial direction and causing excessive damage to any casing that has been set in the well, such as casing 13. This damage can cause weakened pressure resistance or even cause holes to wear in the casing. Since the integrity of the casing is a vital factor in maintaining safe drilling, it is important to not excessively wear the casing that must hold the wellbore pressure.

It is, therefore, the specific feature of the present invention to provide a method for drilling deviated boreholes in which the borehole casing is protected from excessive wear or damage from the rotation of the drill string as it lies on the lower side or is pulled into the upper side of the wellbore. Referring again to the FIGURE, the casing 13 is illustrated as being cemented in place within the first vertical portion 3 of the wellbore and to a point below the kick-off point 7 for the second deviated portion 9 of the wellbore. Although not shown, it is to be understood that progressively smaller casings may be employed in lieu of the single casing 13 as the wellbore extends into the earth formation. After the drilling of the second deviated portion 9 past the kick-off point 7 and the cementing of casing 13, a casing liner 31 is lowered inside casing 13. Liner 31 has an outside diameter less than the inside diameter of casing 13 and extends coextensively with casing 13 to the end of casing 13 below the kick-off point 7. Liner 31, illustrated as a full casing liner in the FIGURE, is spaced from casing 13 and supported by the casing hanger 32 positioned at the top of the first vertical portion of the wellbore above the kick-off point 7. Should a short casing liner not extending to the top of the casing be alternatively used, it would be supported by a casing hanger positioned at the top of the short liner. The annulus between casing 13 and liner 31 is sealed at the lower ends of the casing and the liner by a mechanism such as packer bore receptacle 35 which also serves to prevent any rotation of the liner within the casing.

After the liner 31 is set in place, the drill string 21 and drill bit 19 are re-run into the wellbore until the drill bit is located below the lower ends of the casing 13 and liner 31. Drilling of the wellbore is then re-started with the drill string rotating while lying on the lower side of the liner. After drilling has continued for a period of time sufficient for the axial movement and rotation of the drill string to cause excessive wear or damage to the liner, drilling is stopped and the drill string and drill bit again are withdrawn from the wellbore. The damaged liner is removed from the wellbore and a replacement liner inserted. The drill string and drill bit are then re-run into the wellbore through the replacement liner and drilling of the wellbore continued. The steps taken to replace the liner when excessively worn or damaged may be repeated as often as needed to fully protect the casing until drilling of the wellbore is complete.

An additional step may be the placing of a liquid under pressure in the annulus between the liner and the casing. Any change, or loss, of pressure in such liquid would be an indication of a hole worn in the liner and the liner could be replaced at that time.

In a further aspect of the invention, the use of a liner enables a wellbore size for drilling ahead equal to the internal diameter of the liner and still be able to set the last casing to a deeper depth. For example, a $13\frac{3}{8}$ inch liner can be supported in a 20 inch casing. When an intermediate casing is needed deeper in the wellbore, the liner can be removed and a $13\frac{3}{8}$ inch casing cemented in place. The annulus for carrying the circulating drilling fluid remains just one nominal size from the $12\frac{1}{4}$ inch drill bit to the surface. Having a common size wellbore from the drill bit to the surface is important for hole-cleaning purposes and for maintaining wellbore integrity.

In one embodiment the casing is 20 inches outside diameter and the liner is 13⅜ inches outside diameter. A 12¼ inch drill bit is utilized. The packer bore receptacle is of the retrievable type supplied under Product No. 683-19 by Baker Packers, a Baker Oil Tools Company, or as illustrated in U.S. Pat. No. 3,420,307 to Conrad (Assignee: Baker Oil Tools, Inc.). The liner may be of the conventional pipe string as used for the casing, or may be of other suitable material. The liner hanger 32 may be of the type illustrated in U.S. Pat. No. 3,420,308 to Putch.

While a preferred embodiment of the invention has been described and illustrated, numerous modifications or alterations may be made without departing from the spirit and scope of the invention as set forth in the appended claims.

We claim:

1. A method of drilling a deviated wellbore into the earth by a rotary drilling technique wherein a drill string is used to advance a drill bit through the earth and a drilling fluid is circulated down the drill string and returned from the wellbore in the annulus formed about the drill string, comprising the steps of:

(a) drilling a vertical first portion of said wellbore into the earth from a surface location to a kick-off point at about the lower end of said first portion by rotating and advancing a drill string and drill bit into the earth, (b) initiating a deviated second portion of said wellbore at said kick-off point, (c) withdrawing said drill string and drill bit from said wellbore, (d) lowering a casing into said borehole and cementing said casing in place from the earth's surface to a point below said kick-off point, (e) lowering a casing liner within said casing, said liner having an outside diameter less than the inside diameter of said casing and extending coextensively with said casing at least from above said kick-off point to the lower end of said casing below said kick-off point, (f) spacing said liner from said casing, (g) affixing said liner so that it is not free to rotate within said casing, (h) running said drill string and drill bit through said liner until said drill string lies along the lower side of said liner below said kick-off point and said drill bit is located below the lower end of said liner, whereby said liner protects said casing from damage by the rotation of said drill string during the drilling of said second deviated portion of said wellbore, (i) drilling said deviated second portion of said wellbore by rotation of said drill string as it lies along the lower side of said liner, (j) pulling said drill string and drill bit from said wellbore after excessive wear has been imparted to said liner by the rotation of said drill string as it lies on the lower side, or is pulled into the upper side, of said liner, (k) withdrawing said liner from said wellbore, (l) lowering a replacement liner within said casing, said replacement liner also extending coextensively with said casing at least from above said kick-off point to the lower end of said casing below said kick-off point, and (m) rerunning said drill string and drill bit into said wellbore and continuing the drilling of said deviated second portion of said wellbore, and (n) repeating steps (k) through (m) for a plurality of drilling intervals and a plurality of replacement liners until the drilling of the deviated second portion of said wellbore has been completed.

2. The method of claim 1 wherein the step of spacing said liner and replacement liners from said casing includes the step of positioning at least one liner hanger within said casing above said kick-off point and hanging said liner and replacement liners from said liner hanger.

3. The method of claim 1 wherein the step of affixing said liner so that it is not free to rotate includes the step of positioning a mechanism, such as a packer bore receptacle, between the lower end of said liner and said casing.

4. The method of claim 1 wherein the step of pulling said drill string and drill bit from said wellbore takes place after a select drilling interval during which excessive damage to said liner and replacement liners is expected to have occurred.

5. The method of claim 1 wherein said second portion of said deviated wellbore is drilled at an inclination such that said drill string provides no weight to said drill bit during drilling.

6. The method of claim 1 wherein said second portion of said deviated wellbore is drilled at an inclination such that the coefficient of friction of the drill string with the lower side of said liner in the axial direction of said second portion is between 0.0 and 0.2 for a rotating drill string.

7. The method of claim 1 wherein said second portion of said deviated wellbore is drilled at an inclination of at least 60° from the vertical.

8. The method of claim 7 wherein said second portion of said deviated wellbore is drilled at an inclination of at least 80° from the vertical.

9. The method of claim 1 further including the steps of:

(a) placing a liquid under pressure in the annulus between said liner and said casing, (b) replacing said liner upon the change of pressure of said liquid, said change being indicative of a hole worn in said liner by the rotation of said drill string as it lies on the lower side of said liner or is pulled into the upper side of said liner.

10. The method of claim 1 further including the steps of:

(a) withdrawing said liner from the wellbore, (b) extending said casing to a deeper depth by inserting an intermediate casing of the same internal diameter as that of said liner into said wellbore, (c) cementing said intermediate casing in place, (d) containing the drilling of said wellbore to a deeper depth through said intermediate casing, thereby providing a common wellbore size from the drill bit to the surface of the earth.

* * * * *